US005190397A

United States Patent [19]

Bengford et al.

[11] Patent Number: 5,190,397

[45] Date of Patent: Mar. 2, 1993

[54] DOWEL BAR INSERTION METHOD AND APPARATUS FOR CONCRETE PAVING MACHINE

[75] Inventors: Steven C. Bengford, Arthur; Ronald D. Small, Cherokee, both of Iowa

[73] Assignee: Gomaco Corporation, Ida Grove, Iowa

[21] Appl. No.: 670,880

[22] Filed: Mar. 18, 1991

[51] Int. Cl.[5] ..... E01C 23/02; E01C 11/24

[52] U.S. Cl. ..... 404/88; 404/72

[58] Field of Search ..... 425/60, 63; 366/108, 366/128; 404/88

[56] References Cited

U.S. PATENT DOCUMENTS

| | | | |
|---|---|---|---|
| 2,295,947 | 9/1942 | Heltzel | 404/88 |
| 4,433,936 | 2/1984 | Moser | 404/88 |
| 4,688,963 | 8/1987 | Ritchey et al. | 404/88 X |
| 4,798,495 | 1/1989 | Laueppi et al. | 404/88 |
| 4,799,820 | 1/1989 | Laeuppi et al. | 404/88 X |

FOREIGN PATENT DOCUMENTS

| | | | |
|---|---|---|---|
| 247993 | 7/1970 | U.S.S.R. | 404/88 |

*Primary Examiner*—Ramon S. Britts
*Assistant Examiner*—Nancy P. Connolly
*Attorney, Agent, or Firm*—Henderson & Sturm

[57] ABSTRACT

An improved method and apparatus of inserting dowel bars into a newly formed concrete road surface at locations for at least partially forming transverse joints therein includes a slip forming machine for laying a strip of newly formed concrete. A dowel bar placement pan subframe is operably connected to the frame of the machine and extends generally transversely to the direction of forward movement of the frame. The subframe has a plurality of parallel slots disposed therein along the length thereof. A trolley is provided for traveling back and forth across the subframe and has a mechanism therein for storing a plurality of dowel bars therein and permitting the stored dowel bars to roll downwardly one behind the other. A dowel bar stopping device is provided for stopping the lowermost one of the dowel bars at a predetermined position with respect to the trolley. Retainers are operably attached to the subframe and disposed in each of the slots for holding a respective dowel bar in each slot thereof prior to insertion of the dowel bars into the newly formed concrete road surface. The method of using this apparatus includes moving the frame of the machine in a forward direction and slip forming concrete thereby. The trolley is moved across the subframe for each transverse joint to be formed and before the trolley is moved across the subframe, it is filled with dowel bars. The lowermost one of the dowel bars is stopped and each of the lowermost dowel bars is sequentially pushed off of the device which stops it. After the lowermost dowel bar is pushed off of the stops, it is guided into an empty one of the holding devices that it has just passed over as the trolley is moved across the subframe. Once all of the dowel bars have been distributed into the holding devices in the subframe, all of the dowel bars are simultaneously pushed into the newly formed concrete for partially forming a transverse joint therein.

16 Claims, 4 Drawing Sheets

DOWEL BAR INSERTION METHOD AND APPARATUS FOR CONCRETE PAVING MACHINE

TECHNICAL FIELD

The present invention relates generally to a dowel bar insertion method and apparatus for a concrete paving machine and more particularly to an improved method and apparatus for semi-automatically loading of a dowel bar insertion device.

BACKGROUND ART

In concrete slip forming machines used for building roads or the like, it is customary to form joints therein at predetermined intervals so that the elements such as freezing and thawing of the pavement can be accommodated without major damage to the roadway. These dowel bars are typically inserted all the way across the pavement being formed and are generally aligned with the forward movement of the machine. These joints can be perpendicular to the slab and to the direction of forward movement of the machine or they can extend across the strip of concrete being formed at somewhat of an angle thereto, which is commonplace in present day road construction so that each set of tires on a vehicle does not hit the joint at precisely the same time, thereby lessening the thumping problem that sometimes occurs when the concrete joints are perpendicular to the direction of movement of the vehicle thereon.

The aforementioned concrete slip forming machines have for many years used dowel bar insertion mechanisms thereon, for example like those shown in U.S. Pat. Nos. 4,798,495 and 4,799,820, both to Laeuppi et al and both of which are incorporated herein by reference.

Another common way to construct a dowel bar inserting apparatus is to utilize a trolley which is loaded with dowel bars on one side of the machine as it moves forward and then the trolley is moved transversely across the machine along a dowel bar placement pan subframe. As the trolley moves along the subframe, a cam device is actuated once for each place that a dowel bar retaining mechanism is disposed across the subframe. This cam operated device consequently pushes the lowermost one of the dowel bars in the trolley upwardly and outwardly into a respective dowel bar retaining mechanism. Once the subframe reaches a position where the joint in the concrete is to be formed, a pair of forked vibrating members for each dowel bar is actuated to push each of the dowel bars downwardly past the dowel bar holding mechanisms and into the concrete itself. After that, the dowel bar retaining mechanisms disposed across the subframe must again be loaded in the same fashion as discussed above wherein the trolley is manually filled with dowel bars from one side of the machine and then the trolley is moved across the subframe so that each of the dowel bar retaining mechanisms across the subframe will again receive a dowel bar as the cam operated device is actuated, one for each dowel bar retaining mechanism as the trolley moves across the subframe.

In this cam operated prior art device, the trolley needs to be loaded from only one side and it will distribute the dowel bars loaded thereon only in one direction of movement of the trolley across the subframe.

After each set of dowel bars is inserted into the concrete at each joint, the paving machine is provided with a mechanism for smoothing out the place where the dowel bars have been inserted. At some later time, a groove is sawed into the joint above where the dowel bars were inserted to complete the joint in the pavement. Each joint is formed using the same procedure so the trolley must be filled again each time, and as the trolley is made to travel across the machine transverse to its forward travel, the dowel bars need to be distributed into the respective dowel bar holders as described above.

The major problem with these prior art structures has been that the cam operated system of ejecting dowel bars from the trolley is slow and has not been one hundred percent reliable. Additionally, the moving parts of the cam operated ejecting system are subject to wear and consequently need to be repaired or replaced more frequently than is desirable. Accordingly, there is a need for an improved method and apparatus for positioning dowel bars for insertion into concrete in a slip forming paver.

DISCLOSURE OF THE INVENTION

The present invention relates generally to an improved method and apparatus of inserting dowel bars into a newly formed concrete road surface at locations for at least partially forming transverse joints therein. The apparatus includes a slip forming machine for laying a strip of newly formed concrete adapted for movement in a forward direction. A dowel bar placement pan subframe is operably connected to the frame of the machine and extends generally transversely to the direction of forward movement of the frame. The subframe has a plurality of parallel slots disposed therein along the length thereof.

A trolley is provided for traveling back and forth across the subframe and has a mechanism therein for storing a plurality of dowel bars therein and permitting the stored dowel bars to roll downwardly one behind the other. A dowel bar stopping device is provided for stopping the lowermost one of the dowel bars at a predetermined position with respect to the trolley. Retainers are operably attached to the subframe and disposed in each of the slots for holding a respective dowel bar in each slot thereof prior to insertion of the dowel bars into the newly formed concrete road surface.

The method of using this apparatus includes moving the frame of the machine in a forward direction and slip forming concrete thereby. The trolley is moved across the subframe for each transverse joint to be formed and before the trolley is moved across the subframe, it is filled with dowel bars. The lowermost one of the dowel bars is stopped and each of the lowermost dowel bars is sequentially pushed off of the device which stops it. This pushing of the lowermost dowel bar is done primarily in a horizontal direction at a point between each of the slots in the subframe as the trolley is moved across the subframe. After the lowermost dowel bar is pushed off of the stops, it is guided into an empty one of the holding devices that it has just passed over as the trolley is moved across the subframe. Once all of the dowel bars have been distributed into the holding devices in the subframe, all of the dowel bars are pushed into the newly formed concrete for partially forming a transverse joint therein.

An object of the present invention is to provide an improved apparatus for distributing dowel bars to a dowel bar inserting apparatus.

Another object of the present invention is to provide an apparatus of the aforementioned type which is faster and more dependable than prior art devices of a similar type.

A still further object of the present invention is to provide an apparatus of the aforementioned type which is more economical to construct and requires less maintenance than prior art devices.

A still further object of the present invention is to provide a dowel bar distributing method and apparatus which will operate in either or both directions of the trolley and which can be loaded from either or both sides of the slip forming machine.

Another object of the present invention is to provide a dowel bar distributing method and apparatus which is easy to adapt to insertion of different sized dowel bars without major modification to the device.

Other objects, advantages, and novel features of the present invention will become apparent from the following detailed description of the invention when considered in conjunction with the accompanying drawings.

BEST MODE FOR CARRYING OUT THE INVENTION

Figure 1:
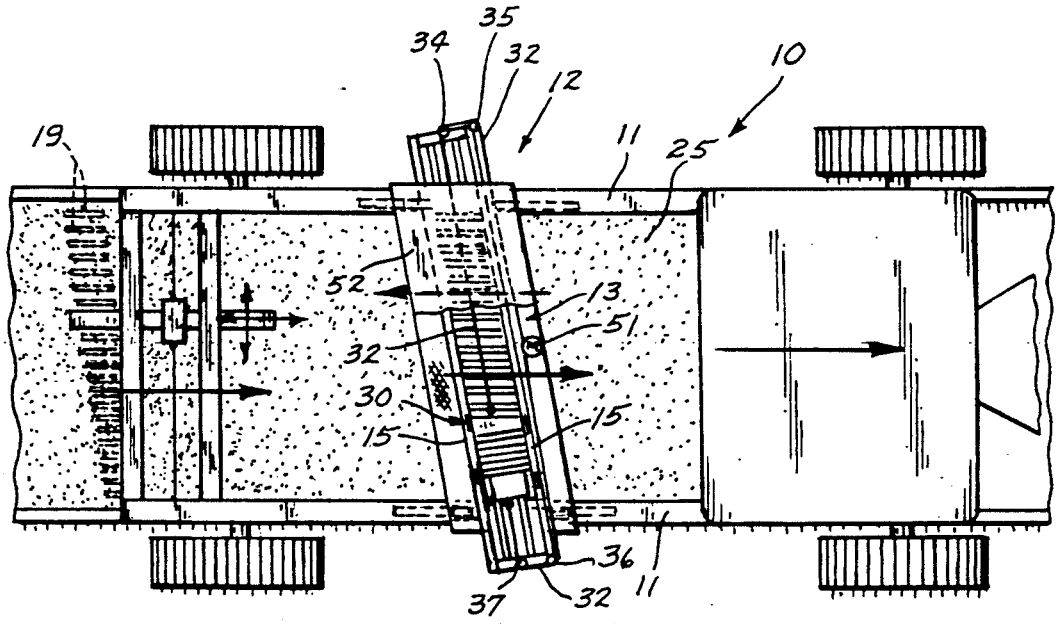
FIG. 1 is a top plan view of a slip forming concrete paver with the dowel bar inserting mechanism of the present invention attached thereto.

Referring to the drawings wherein like reference numerals designate identical or corresponding parts throughout the several views, FIG. 1 shows a slip forming paving machine (10) having a frame (11) and a dowel bar inserting mechanism (12) attached to the frame (II).

Figure 6:
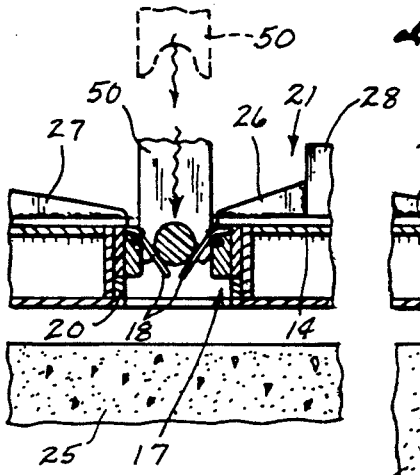
FIG. 6 is an enlarged partial cross sectional view showing a part of what is shown in FIG. 5 but showing how vibrating dowel bar insertion forks are used to push dowel bars from their retainers into the newly formed concrete.

The dowel bar inserting mechanism (12) includes a subframe (13) which includes plates (14) connected together with side rails (15) to form slots (16). Dowel bar retainers (17) have spring steel members (18) disposed thereon for holding a dowel bar (19) in position as shown in FIG. 6, for example, before insertion into the newly formed concrete. The retainers (17) fit down onto a ledge (20) so that the retainers (17) cannot go down beyond the ledge (20) and dowel bar extractors (21) are, bolted ,to the plates (14) through holes (22) and (23) in hold down member (24) to thereby hold down the retainer (17) at four different places by four different ones of these retainers (21). Each of the retainers (21) has a short ramp (26) and a long ramp (27) disposed thereon.

Figure 4:
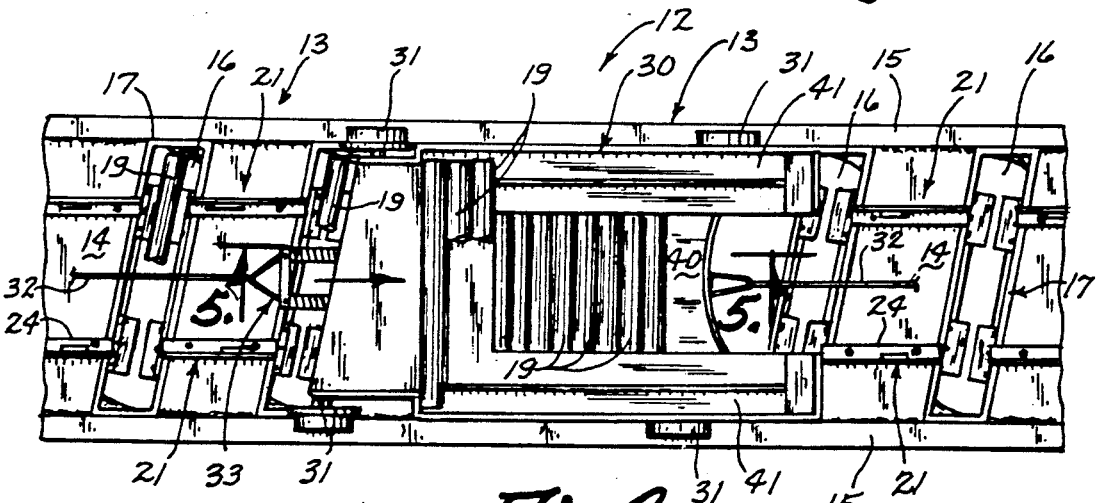
FIG. 4 is a top plan view taken along line 4—4 of FIG. 2 showing the trolley in one direction of movement for distributing dowel bars into retainers in the subframe.

A trolley (30) is disposed for movement along the subframe (13) because wheels (31) roll on tracks or rails (15) of the subframe (13). The trolley (30) is movable by pulling on a continuous cable (32) which is connected through a spring harness (33) as shown in FIG. 4 and over idler pulleys (34), (35), (36) and (37) as can best be seen in FIG. 1. Motor (51) can be actuated in either direction to pull the cable (32) and trolley (30) in either direction as desired. Ramps (40) and (41) on the trolley (30) constitute a dowel bar storage device so that the dowel bars (19) can roll down the ramps (40) and (41) until the lowermost one of the dowel bars (19) stops on tabs (42).

In operation of the present invention, as the slip forming paver (10) passes forwardly as shown in FIG. 1, the slab of newly formed concrete (25) will be formed as is conventional in this art. The trolley (30) will be filled with an adequate number of dowel bars (19) corresponding at least to the number of retainers (17) disposed across the subframe (13). This loading process can begin once the trolley has returned to its parked position at either end of the subframe or pan. The loading process can be done from either side of the machine (10) and from either end of the subframe pan (13). After the trolley (30) has been loaded with dowel bars (19), then the trolley (30) is moved across the subframe or pan (13) from one side to the other. The drawings herein show only one direction of travel for moving the dowel bars from the trolley to the retainers (17). It is to be understood, however, that the trolley (30) can be moved in the opposite direction with a full load of dowel bars (19) and it will work just as well in such opposite direction as it does in the direction shown.

Figure 5:
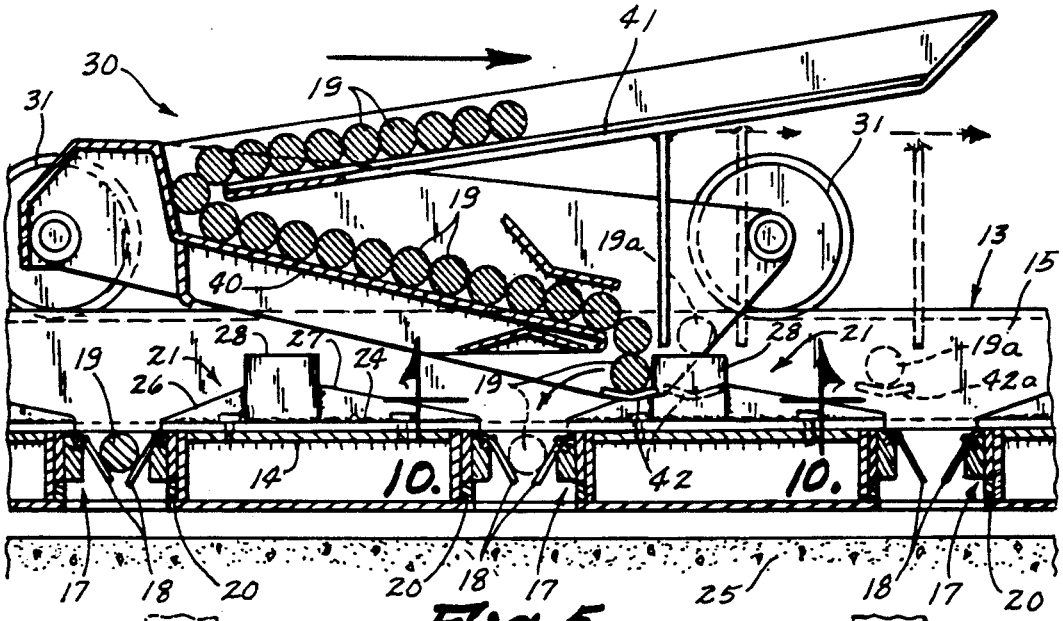
FIG. 5 is an enlarged cross sectional view taken along line 5—5 of FIG. 4 showing operation of the device in one direction of movement of the trolley.

As the trolley (30) moves past the leftmost extractor (21) wherein a dowel bar (19) has been placed in the retainer (17), the lowermost dowel bar (19) will be held in the position shown in FIG. 5 by the tabs (42) until it bumps against the stops (28) of the extractor (21). As the trolley (30) continues to move to the right from the position shown in solid lines in FIG. 5, the retainer (28) will push the lowermost dowel bar (19) in the direction of the arcuate arrow and down into the dashed line position of dowel bar (19) in the retainer (17) in the center of FIG. 5.

As the trolley (30) continues to move to the right to the second dashed line position indicated by designation of dowel bar (19*a*) and tab (42*a*) in FIG. 5, it can be seen that the next dowel bar above the tab (42) will drop down thereon once the lowermost dowel bar (19) has been pushed of the stop (42). It is to be understood that the tab (42*a*) is actually the same tab (42), but in an advanced position. The different designation is merely to facilitate this explanation thereof and not to indicate that there is another tab, other than the two tabs (42) attached to the trolley (30).

Figure 2:
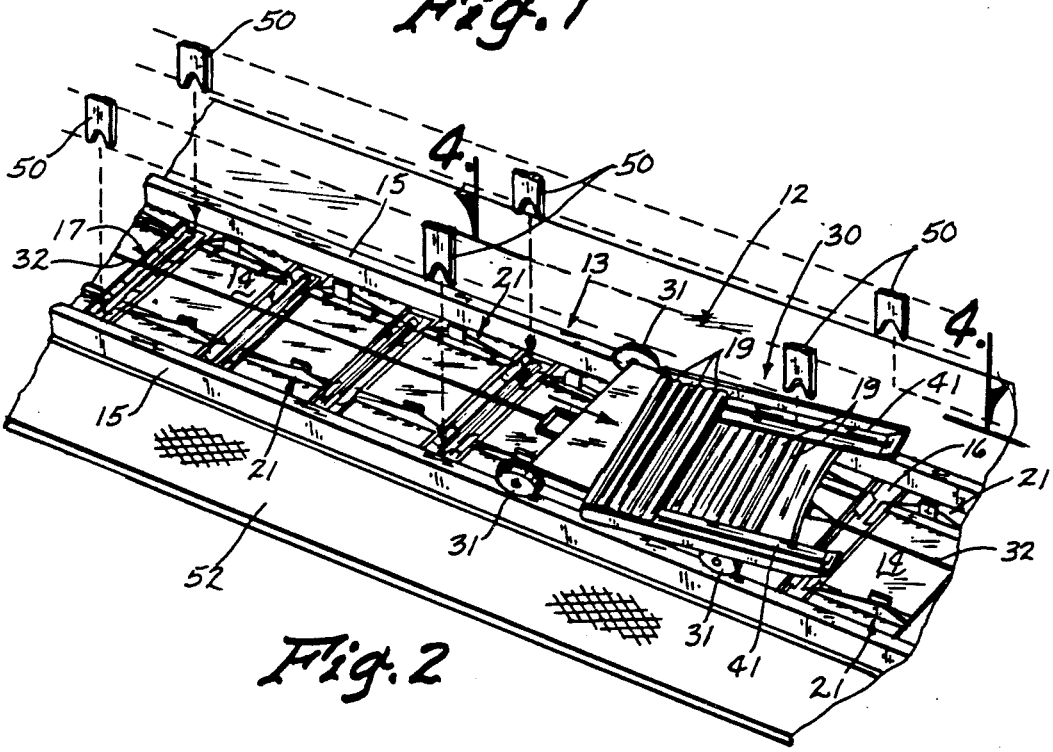
FIG. 2 is an enlarged perspective view of a portion of the dowel bar insertion mechanism shown in FIG. 1 showing the trolley going in one of two possible direction.
Figure 3:
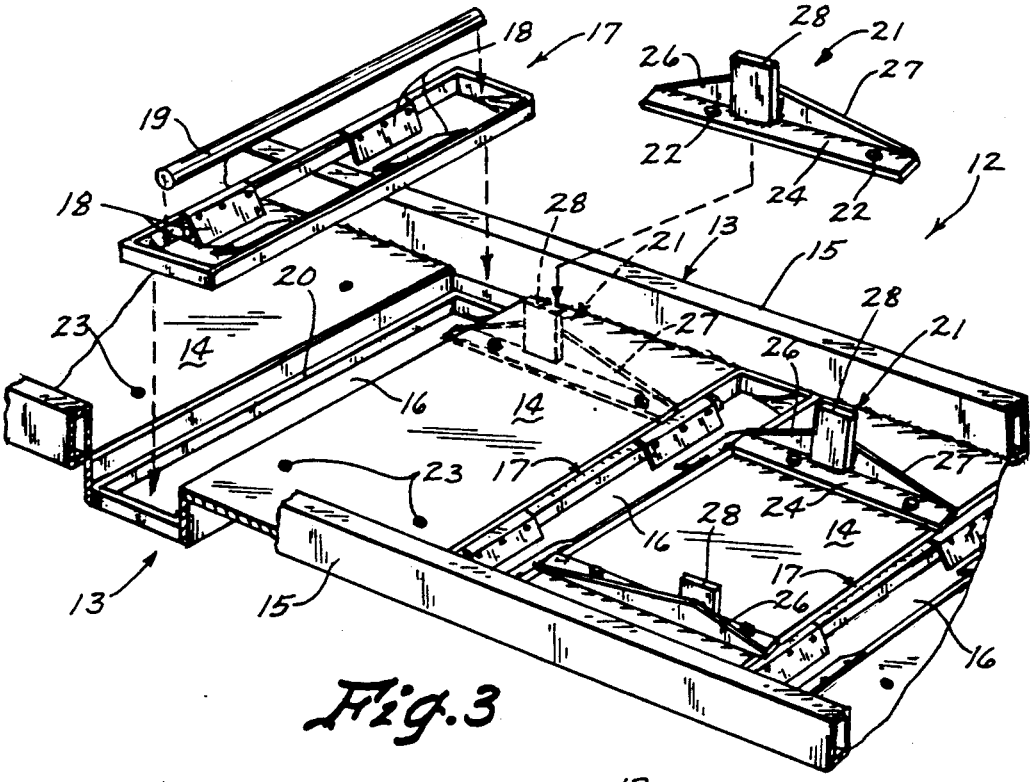
FIG. 3 is an enlarged exploded perspective view of a section of the dowel bar replacement pan subframe and of the retainer devices for holding each respective dowel bar, the dowel bar extractors and the guides for guiding each dowel bar into each retainer.
Figure 7:
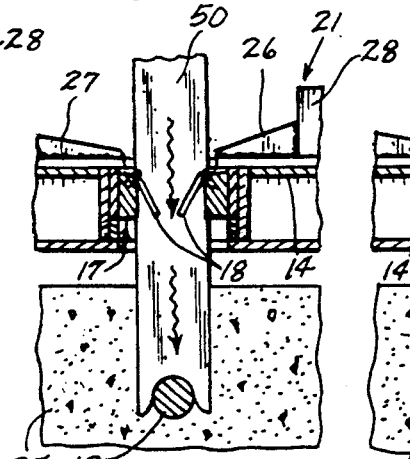
FIG. 7 is a view like FIG. 6 but showing the dowel bar inserter forks at their lowermost position of travel with the dowel bar having been pushed into the newly formed concrete.
Figure 8:
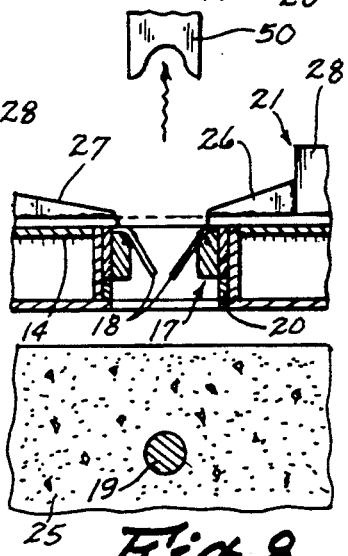
FIG. 8 shows the retracted position of the dowel bar inserting forks and showing how the retainer is ready to accept another dowel bar and hold it into place until the next joint is to be formed.

Once all of the retainers (17) have been filled all the way across the subframe pan (13), the dowel bars (19) can be inserted at the appropriate time. The pan (30) can again be filled with. dowel bars at any time that it is at either end of the pan or subframe (13), at either side of the machine (10). Once the dowel bar insertion device (12) is at the proper position where a joint is desired to be formed, the vibrating forks (50) will be actuated from the position shown in FIGS. 2 and 8 to the position shown sequentially in FIGS. 6 and 7 to insert the dowel bars (19) into the newly formed concrete (25). The vibrating forks (50) are raised again to the position shown in FIGS. 2 and 8 and are held in that position until such time that another set of dowel bars (19) is to be inserted to form another joint.

Figure 9:
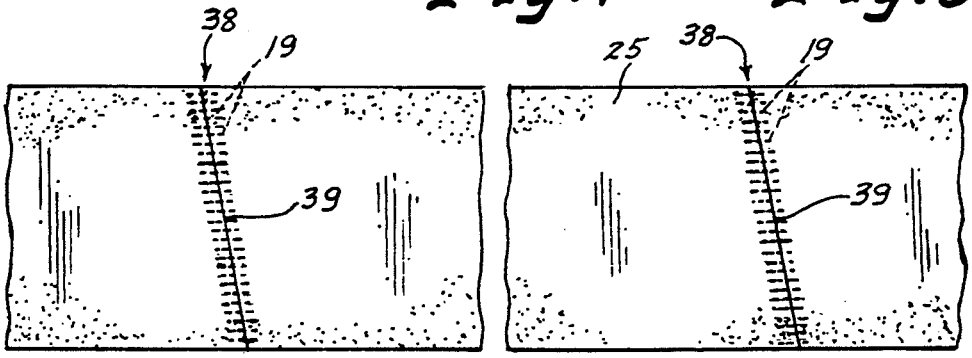
FIG. 9 is a top plan view of a slip formed concrete slab having joints formed as indicated by the dowel bars in dashed lines and the groove sawed across the top of the dowel bars in the top of the concrete slab.
Figure 10:
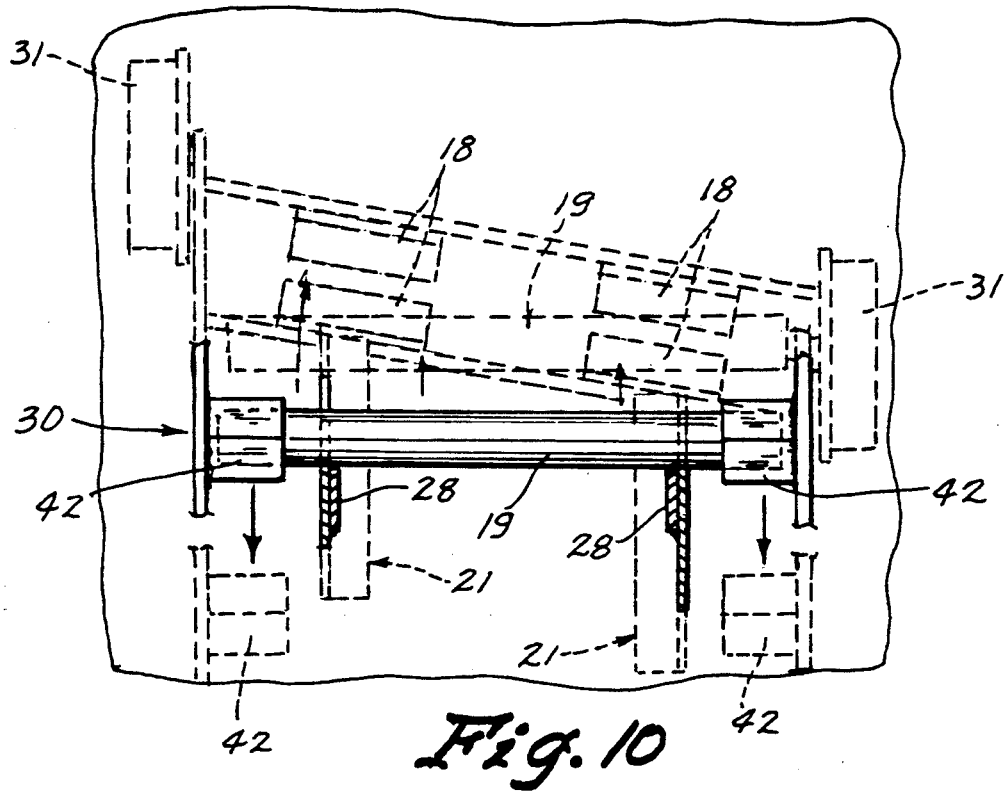
FIG. 10 is a cross sectional view taken along line 10—10 of FIG. 5 and showing tabs on the bottom of each side of the trolley which hold the lowermost one of the dowel bars in position and show how the extractors will push the lowermost dowel bar off of the tabs to cause it to move to one of the retainers as shown in FIG. 5.

Referring to FIG. 9, it is noted that joints (38) are formed in the newly formed concrete slab (25) wherein dowel bars (19) are aligned and parallel with the direction of forward travel of the slip forming machine (10) and a groove (39) is cut or sawed into the top of the concrete slab (25) at a position above the dowel bars (19).

A walkway (52) on one side of the rails (15) are provided in case the operator wants to have access to the subframe pan (13) anywhere along its length.

Obviously, many modifications and variations of the present invention are possible in light of the above teachings. It is therefore to be understood that, within the scope of the appended claims, the invention may be practiced otherwise than as specifically described.

I claim:

1. A dowel bar inserting apparatus for the insertion of dowel bars at locations for transverse joints in a newly formed concrete road surface for attachment to a slip forming machine having a frame with means for propelling said frame in a forward direction, a dowel bar placement pan subframe operably connected to said frame, said placement pan subframe having a subframe longitudinal axis and extending generally transversely to the direction of forward movement of said frame, said subframe having a plurality of slots disposed therein along the length thereof, each of said slots also having a slot longitudinal axis which is generally parallel to said forward direction, the slot longitudinal axis of each slot being generally parallel to the slot longitudinal axis of each other respective slot, a trolley means for traveling back and forth across said subframe along said subframe longitudinal axis, means for storing a plurality of dowel bars in said trolley means, means for permitting said stored dowel bars to roll downwardly one behind another, dowel bar stopping means for stopping the lowermost one of said dowel bars in a predetermined position with respect to said trolley means, retainer means operably attached to said subframe and disposed in each of said slots for holding a respective dowel bar in each slot thereof prior to insertion of said dowel bars into said newly formed concrete road surface, the improvement comprising:

dowel bar extractor means operably attached to said subframe between each of said slots for moving said lowermost one of said dowel bars in primarily a horizontal direction from said predetermined position with respect to said trolley means whereby it can drop into one of said dowel bar holding means; and means for guiding said lowermost dowel bar from said predetermined position to said respective dowel bar holding means after said lowermost dowel bar contacts said dowel bar extractor means.

2. The apparatus of claim 1 wherein said dowel bar extractor means further includes a pair of dowel bar engagement surface means for contacting said lowermost dowel bar at substantially the same instant so that both ends of said lowermost dowel bar are pushed off of said dowel bar stopping means at substantially the same time.

3. The apparatus of claim 1 wherein said guiding means comprises ramp means extending from said dowel bar engaging means to said dowel bar holding means for guiding said lowermost dowel bar downwardly into one of said dowel bar holding means.

4. The apparatus of claim 3 wherein said subframe has a longitudinal axis which is obliquely disposed with respect to the forward direction of travel of said machine and each of said respective slots have a longitudinal axis, each of which are disposed at an oblique angle with respect to the direction of travel of said trolley means.

5. The apparatus of claim 3 wherein said ramp means is longer on one side thereof than on the other side thereof.

6. The apparatus of claim 1 including hold down means for releasably affixing said dowel bar retainer means to said subframe and securing said retainer means into said respective slots of the subframe.

7. The apparatus of claim 6 wherein said dowel bar extractor means are operably and integrally attached to said hold down means.

8. The apparatus of claim 6 including a second set of dowel bar retainer means for holding dowel bars of a different size than the first said dowel bar retainer means whereby said second set of dowel bar retainer means can replace the first said dowel bar retainer means in the slots in said subframe by use of said hold down means by first releasing the first said dowel bar retainer means and then affixing said second set of dowel bar retainer means to said subframe.

9. The apparatus of claim 1 including means for permitting said dowel bar extractor means to function in either direction of travel of said trolley means.

10. The apparatus of claim 1 wherein said extractor means is rigidly affixed to said subframe.

11. The apparatus of claim 1 including means for preventing said extractor means from movement with respect to said subframe during operation thereof.

12. The apparatus of claim 1 wherein said dowel bar stopping means comprises a pair of spaced apart tabs disposed on the outer and lower part of said trolley means and under each respective end of said lowermost dowel bar, and said dowel bar extractor means includes means for contacting said lowermost dowel bar on an intermediate portion thereof between said pair of spaced apart tabs.

13. A method of inserting dowel bars into a newly formed concrete road surface at locations for at least partially forming transverse joints therein using an apparatus of the type including a slip forming machine for laying a strip of newly formed concrete, said machine having a frame with means for propelling said frame in a forward direction, a dowel bar placement pan subframe operably connected to said frame and extending generally transversely to the direction of forward movement of said frame, said subframe having a plurality of parallel slots disposed therein along the length thereof, a trolley means for traveling back and forth across said subframe, means for storing a plurality of dowel bars in said trolley means, means for permitting said stored dowel bars to roll downwardly one behind another, dowel bar stopping means for stopping the lowermost one of said dowel bars in a predetermined position with respect to said trolley means, retainer means operably attached to said subframe and disposed in each of said slots for holding a respective dowel bar in each slot thereof prior to insertion of said dowel bars into said newly formed concrete road surface, said method comprising:

moving said frame in a forward direction;

moving said trolley means across said subframe for each transverse joint to be formed;

filling said storage means in the trolley means with dowel bars from time to time;

stopping the lowermost one of said dowel bars in said trolley means;

sequentially pushing the lowermost one of said dowel bars off of said stopping means in primarily a horizontal direction at a point between each of said slots in said subframe as said trolley means is moved across said subframe;

guiding each one of said lowermost dowel bars into an empty one of said holding means that it has just passed over as the trolley means is moved across said subframe; and simultaneously pushing all of said dowel bars disposed in said holding means into said newly formed concrete for partially forming a transverse joint in said newly formed concrete.

14. A dowel bar inserting apparatus for the insertion of dowel bars at locations for transverse joints in a newly formed concrete road surface for attachment to a slip forming machine having a frame with means for propelling said frame in a forward direction, a dowel bar placement pan subframe operably connected to said frame and extending generally transversely to the direction of forward movement of said frame, said subframe having a plurality of parallel slots disposed therein along the length thereof, a trolley means for traveling back and forth across said subframe, means for storing a plurality of dowel bars in said trolley means, means for permitting said stored dowel bars to roll downwardly one behind another, dowel bar stopping means for stopping the lowermost one of said dowel bars in a predetermined position with respect to said trolley means, a first set of retainer means operably attached to said subframe and disposed in each of said slots for holding a respective dowel bar of a first size in each slot thereof prior to insertion of said dowel bars into said newly formed concrete road surface;

dowel bar extractor means operably attached to one of said subframe and trolley means for moving said dowel bars, one at a time, from said predetermined position with respect to said trolley means whereby said dowel bars can drop into a respective one of said dowel bar holding means;

a second set of dowel bar retainer means for holding dowel bars of a different size than said first set of dowel bar retainer means whereby said second set of dowel bar retainer means can replace the first set of dowel bar retainer means in the slots in said subframe; and hold down means for releasably affixing said first or second dowel bar retainer means to said subframe thereby securing said retainer means into said respective slots of the subframe, whereby use of said hold down means can be used by first releasing the first said down bar retainer means and then affixing said second set of dowel bar retainer means to said subframe with said hold down means, or vice versa, permits either one of the two sets of down bar retainer means to be used.

15. The apparatus of claim 14 wherein said dowel bar extractor means ar operably and integrally attached to a respective one of said hold down means.

16. The apparatus of claim 1 including means for permitting said extractor means to operate in either of two directions of travel of said trolley means.

* * * * *